US009649662B2

(12) United States Patent
Strachan

(10) Patent No.: US 9,649,662 B2
(45) Date of Patent: May 16, 2017

(54) SEAMLESS REINFORCED CONCRETE STRUCTURAL INSULATED PANEL

(71) Applicant: ZKS, LLC, Portland, OR (US)

(72) Inventor: Zachery Strachan, Portland, OR (US)

(73) Assignee: ZKS, LLC, Portland, OR (US)

( * ) Notice: Subject to any disclaimer, the term of this patent is extended or adjusted under 35 U.S.C. 154(b) by 0 days.

(21) Appl. No.: 13/964,391

(22) Filed: Aug. 12, 2013

(65) Prior Publication Data

US 2014/0137499 A1 May 22, 2014

Related U.S. Application Data

(60) Provisional application No. 61/729,300, filed on Nov. 21, 2012.

(51) Int. Cl.

| | |
|---|---|
| ***E04C 2/288*** | (2006.01) |
| ***B05D 7/00*** | (2006.01) |
| ***E04C 2/04*** | (2006.01) |
| ***E04C 2/06*** | (2006.01) |
| ***B28B 1/29*** | (2006.01) |
| ***B28B 19/00*** | (2006.01) |
| *B28B 1/30* | (2006.01) |
| *B28B 1/52* | (2006.01) |

(52) U.S. Cl.

CPC ..... *B05D 7/50* (2013.01); *B28B 1/29* (2013.01); *B28B 1/52* (2013.01); *B28B 19/003* (2013.01); *B28B 19/0015* (2013.01); *E04C 2/044* (2013.01); *E04C 2/049* (2013.01); *E04C 2/06* (2013.01); *B28B 1/30* (2013.01); *B28B 1/522* (2013.01)

(58) Field of Classification Search

None

See application file for complete search history.

(56) References Cited

U.S. PATENT DOCUMENTS 3,922,413 A * 11/1975 Reineman ..... E04C 2/2885 264/129
4,067,164 A 1/1978 McMillan
4,280,974 A * 7/1981 Piazza ..... 264/69

(Continued)

FOREIGN PATENT DOCUMENTS

EP 1192321 A1 4/2002
RU 2268148 C1 1/2006

OTHER PUBLICATIONS

The PCT Search Report and Written Opinion mailed Dec. 26, 2013 for PCT application No. PCT/US13/55464, 7 pages.

(Continued)

*Primary Examiner* — Elizabeth A Quast

(74) *Attorney, Agent, or Firm* — Miller Nash Graham & Dunn LLP

(57) ABSTRACT

A structural insulated panel includes a core of thermally insulating material having a first side and a second side opposite the first side, a first skin coupled to the first side of the core, and a second skin coupled to the second side of the core. The first skin, the second skin, or both the first and second skins may include a sheet of reinforced concrete material. Each sheet of reinforced concrete material may include calcium sulfoaluminate (CSA) cement and a reinforcing material disposed in at least a portion of the CSA cement.

30 Claims, 7 Drawing Sheets

(56) References Cited

U.S. PATENT DOCUMENTS

| | | | | |
|---|---|---|---|---|
| 5,372,769 | A * | 12/1994 | Ryberg | B28B 23/0068 264/254 |
| 5,803,964 | A * | 9/1998 | Scarborough | 106/724 |
| 5,916,361 | A | 6/1999 | Molloy et al. | |
| 6,620,487 | B1 | 9/2003 | Tonyan et al. | |
| 7,549,259 | B2 | 6/2009 | Calle | |
| 7,562,502 | B2 | 7/2009 | Calle | |
| 7,874,122 | B2 | 1/2011 | Calle | |
| 8,038,790 | B1 * | 10/2011 | Dubey et al. | 106/675 |
| 8,065,853 | B2 | 11/2011 | Tonyan et al. | |
| 2004/0040237 | A1 | 3/2004 | Van Ootmarsum | |
| 2005/0064145 | A1 * | 3/2005 | Hoie et al. | 428/167 |
| 2007/0175126 | A1 * | 8/2007 | Tonyan et al. | 52/223.7 |
| 2009/0078161 | A1 * | 3/2009 | Woolfsmith et al. | 106/692 |
| 2009/0081446 | A1 * | 3/2009 | Woolfsmith et al. | 428/323 |
| 2010/0050555 | A1 * | 3/2010 | Knight | E04C 1/41 52/588.1 |
| 2010/0089002 | A1 * | 4/2010 | Merkel | 52/831 |
| 2010/0310846 | A1 * | 12/2010 | Berke et al. | 428/219 |
| 2012/0073228 | A1 * | 3/2012 | Fork et al. | 52/309.13 |
| 2012/0312193 | A1 * | 12/2012 | Jezequel et al. | 106/678 |
| 2013/0133554 | A1 * | 5/2013 | Lloyd et al. | 106/695 |
| 2014/0141160 | A1 | 5/2014 | Strachan | |

OTHER PUBLICATIONS

Automated Builder, "T. Clear Invests in Machinery Development for Improved Panel Production," Pre May 2010, retrieved at <<www.automatedbuilder.com>> 1 page.

Concrete Sandwich Walls, retrieved on Aug. 23, 2012 at <<http://www.cswall.com/>>, 18 pages.

ProTEC Concrete Structural Insulated Panel System, available at least as early as Sep. 1, 2012, 20 pages.

Solarcrete, Solarcrete Structural Insulated Panels—Advantages, retrieved on Aug. 23, 2012 at <<http://www.solarcrete.com/>>, 14 pages.

T Clear Corporation, Press Release, Immediate Issue, Mar. 26, 2010, 12 pages.

T. Clear Corporation ProTEC Concrete Structural Panel System, Revised May 26, 2010, 10 pages.

T. Clear Corporation, "Sips Housing Systems," retrieved on Aug. 23, 2012 at <<http://www.tclear.com/sips-housing-systems/index.php>>, 12 pages.

* cited by examiner

SEAMLESS REINFORCED CONCRETE STRUCTURAL INSULATED PANEL

RELATED APPLICATION

This application claims the benefit of U.S. Provisional Application Ser. No. 61/729,300, filed Nov. 21, 2012, entitled "SEAMLESS REINFORCED CONCRETE STRUCTURAL INSULATED PANEL," which is incorporated herein by reference in its entirety.

BACKGROUND

Numerous different techniques exist for building structures. One existing construction technique employs structural insulated panels (SIPs) to form some or all of the structure. SIPs are most commonly made of oriented strand board (OSB) skins adhesively bonded to foam cores, but are also produced with various type of concrete or cementituous facings. Cement based SIPs, often referred to as CSIPs, provide numerous advantages. For instance, CSIPs do not require separately installed exterior weather resistant finishes such as stucco or siding, or interior finishes such drywall or paneling. CSIPs are potentially much more durable than OSB based SIPs because, being cement based, their facings are not subject to dry rot, swelling from absorption of moisture, or spreading flame or smoke during fire.

CSIPs can be generally classified under one of two categories: (1) those that are produced by bonding thin, commercially available cement sheets to foam cores using an adhesive, (2) those produced by spray or trowel applying fresh cement directly to foam at a construction site where the building is being constructed, and (3) those formed by factory precasting.

The first category of CSIP is manufactured by adhesively pressure bonding commercially produced fiber cement sheets to a foam core. This system has several disadvantages. The CSIPs must have facing seams approximately every four feet of length, because that is the commercially produced with of fiber cement sheet available. These facing seams require additional interior and exterior finish work to weather proof and cosmetically conceal, and to achieve the traditional look of drywall or stucco. The seams are subject to cracking, and ongoing maintenance. Commercially produced fiber cement sheets are typically made with the Hatchek process wherein the cement is manufactured of many very thin sheets which are pressed together to form a final thickness, thus it is possible for the many thin sheets to delaminate from one another under certain conditions. The fiber cement sheets are typically produced with high percentages of cellulose fiber which can wick moisture and swell under certain conditions.

The second category of CSIP system is constructed by placing the foam core in its installed position at the construction site (e.g., positioned in an upright position in the case of a wall), and then spraying concrete material onto the foam core to form the CSIP. While this construction technique is capable of producing large, seamless panels, this approach is costly and requires significant skilled labor at the construction site to install the foam and spray the cement onto the foam core. The foam is difficult to keep straight, square and aligned as it is installed, and is easy to dislocate while applying the cement. The quality and repeatability of this construction technique is poor, since the SIP panels are constructed under the uncontrolled and often adverse environmental conditions of the construction site. The quality and repeatability of this construction technique is also highly dependent on the skill of the person applying the concrete material to the foam core.

The third category of CSIP system involves factory precasting or spraying thin fiber reinforced Portland cement facings onto relatively short foam cores, with the cured CSIP then being installed onsite similar to fiber cement CSIP panels of the first category described above. These techniques are not suitable for making large seamless panels since Portland cement is subject to significant drying shrinkage which can cause larger panels (e.g., larger than about 4'×8') to warp, curl and crack. These precast CSIPs are also not conducive to mass production due to the relatively long curing times of Portland cement. A high percentage of expensive polymers are required to eliminate the need to wet-cure the panels and to assist the panels in bonding to the foam, as Portland cement does not naturally bond well to the types of polystyrene foam typically preferred for SIP and CSIP panels. Additionally the hydration of Portland cement results in a high percentage of calcium hydroxide being generated, which grows into and damages some types of reinforcement, such as glass fiber, thus lessening strength and ductility over time. Pozzolans such as silica fume or fly ash may be used to reduce the amount of calcium hydroxide generated, but add significantly to material cost and pose additional manufacturing challenges because they are highly respirable and damaging to lung tissue.

Thus, existing CSIP systems are costly, labor intensive to produce, have potential weaknesses or faults, have poor quality and repeatability, and/or are limited to relatively small sized panels.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
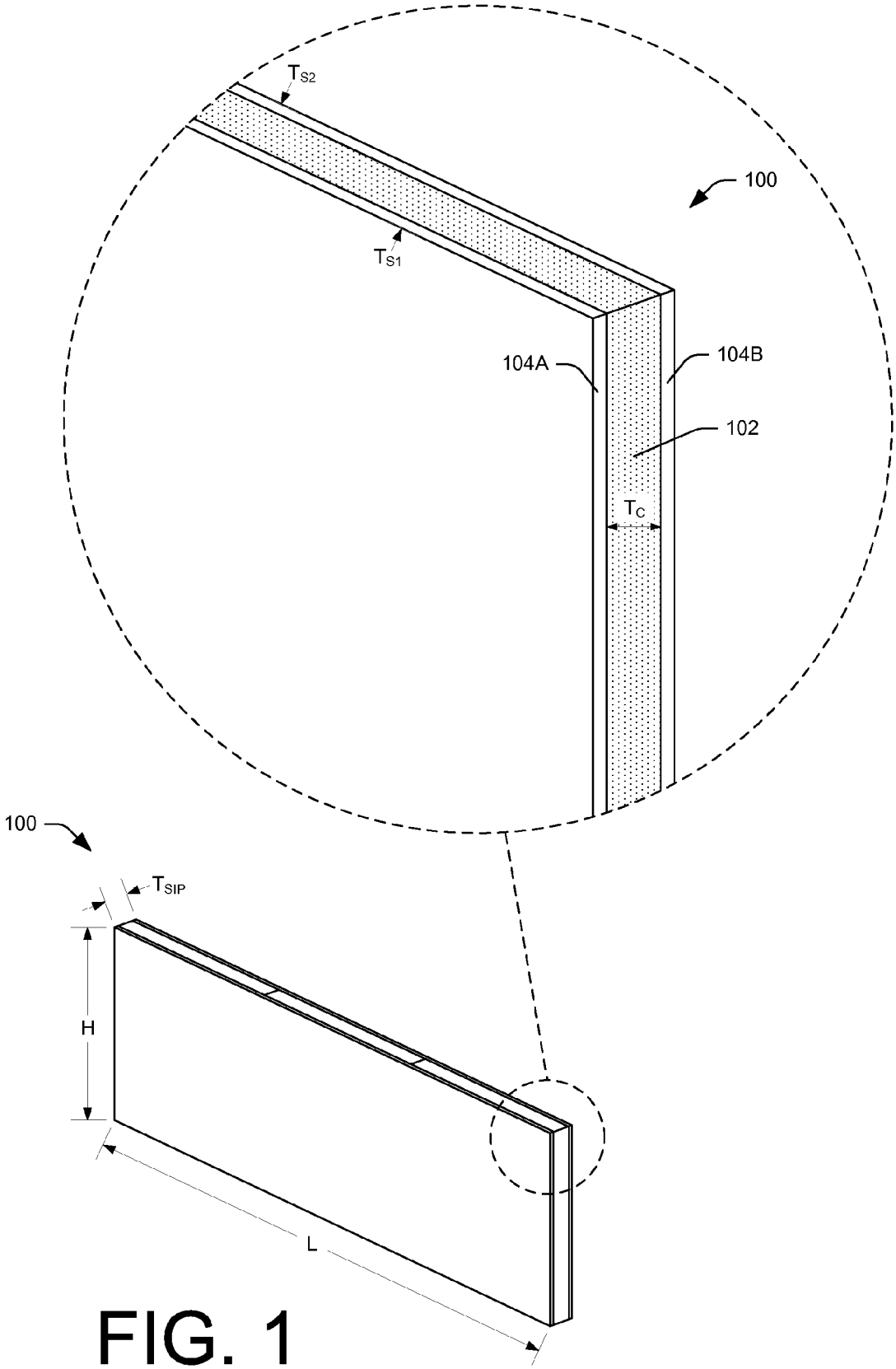
FIG. 1 is a schematic diagram of an example seamless reinforced concrete structural insulated panel (CSIP) comprising a core sandwiched between two skins of reinforced concrete material.

As discussed above, existing concrete structural insulated panel (SIP) systems are costly, labor intensive to produce, have potential weaknesses or faults, have poor quality and repeatability, and/or are limited to relatively small sized panels. This application describes example reinforced CSIPs and example methods of making such reinforced CSIPs. In some examples, CSIPs according to this application are faster, simpler, and/or less costly to manufacture than existing CSIPs. Additionally, in some examples, CSIPs according to this application may be made according to a process that is highly repeatable and produces CSIPs having finished surfaces suitable for use with little or no additional finishing operations. This application also describes methods by which CSIPs, such as those described herein, can be made having lengths of eight feet or more, without seams on the interior and/or exterior walls. Thus, in some examples, fewer finishing operations, such as mudding, taping, spackling, texturing, etc. may be employed when using the CSIPs described herein to construct a building, thereby reducing the construction costs for the building. Some or all of these, and numerous other, benefits may be achieved by using CSIPs according to the examples described in this application.

CSIPs according to this disclosure include a core of lightweight thermally insulating material with skins of reinforced concrete material applied to one or both sides of the core. While the CSIPs illustrated herein include skins of reinforced concrete material on both sides of the core, in other examples, CSIPs may be constructed according to this disclosure having a reinforced concrete skin on only one side of the core.

The core may be formed of a wide variety of insulating materials including, for example, polystyrene foam, high density polyethylene foam, polyurethane foam, foamed or aerated concrete, concrete mixed with one or more lightweight aggregates (e.g., polystyrene, pumice or vermiculite), combinations of the foregoing, or the like. In some embodiments, the core itself may be reinforced (e.g., with wire, rebar, mesh, woven material, and/or other reinforcing material) prior to application of the skins.

In some embodiments, CSIPs according to this disclosure include a core of lightweight thermally insulating material sandwiched between two skins made of concrete material including a relatively fast-curing and low-shrinkage (FCLS) cement material. As used herein the term "cement" refers to a material that is used as a binder that hardens and cures and binds components together. Cement may be used alone or as an ingredient of a concrete material. "Concrete" material refers to a composition of one or more cements along with other ingredients, such as aggregate, reinforcing material, and the like.

In one embodiment, calcium sulfoaluminate or calcium sulfoaluminate-belite (collectively referred to herein as "calcium sulfoaluminate cement" or "CSA cement") may be substantially the only cement used in the concrete material. CSA cement is an example of an FCLS cement. In such an embodiment, accelerating agents, shrinkage reducing agents, and/or hydration stabilizing agents may not be needed and, in some instances, may be omitted. In other embodiments, the concrete material may also include some amount of Portland cement. In that case, the concrete material may also include an accelerator to increase curing time, a shrinkage reducing agent to minimize shrinkage, and/or a hydration stabilizer to promote uniformity and consistency of the concrete material during curing. The foregoing embodiments are merely illustrative examples of concrete materials that may be used to make CSIPs according to this disclosure.

In examples employing CSA cement as substantially the only cement in the concrete material, the reinforced concrete material may be substantially free of calcium hydroxide. Calcium hydroxide is commonly present when using other cements, such as Portland cement, and can degrade fibers or other reinforcing materials in the reinforced concrete, as well as cause other problems such as efflorescence and decreased strength and durability. Pozzolans, such as silica fume and fly ash, are sometimes used to react with the calcium hydroxide and reduce the degradation of fibers in fiber reinforced concrete applications. However, the addition of such pozzolans increases the cost of the concrete material and is not entirely effective at preventing degradation of certain fibers. By using CSA cement in some of the examples described herein, the reinforced concrete material used in the CSIPs may minimize or avoid the presence of calcium hydroxide that is harmful to fibers and other reinforcing materials. Consequently, CSIPs according to this application may, in some embodiments, be made of reinforced concrete material that is substantially free of pozzolans. As used herein, the term "pozzolan" refers to any siliceous, or siliceous and aluminous, material material that, in the presence of water, reacts chemically with calcium hydroxide at ordinary temperature to form compounds possessing cementituous properties. However, in other embodiments, such as but not limited to those including Portland cement, pozzolans may be added to the reinforced concrete material.

A wide range of reinforcing materials may be used depending on the desired performance and conditions under which the CSIPs are intended to be used. By way of example and not limitation, the reinforcing material may comprise glass, cellulose, metal, plastic, and/or ceramic. The reinforcing material may be configured in a variety of different forms such as, for example, loose fibers, a mesh, a weave or textile, a lattice structure, and/or wires (e.g., as strands or as a wire frame or cage), for example. The quantity, size, shape, and configuration of the reinforcing material may vary depending on the desired characteristics of the CSIPs. In one specific example, loose glass or cellulose fibers may be used as reinforcing material and may be mixed with the concrete material. In another example, a mesh of glass, cellulose, or plastic (e.g., pultruded or metal meshes) may be used and may be embedded in, applied to, or coated with the concrete material before, during, or after application of the skin(s) to the core.

In one example, a first skin, a second skin, or both the first and second skins may be applied to the core while the respective skin(s) are wet, such that the respective skin(s) bond directly to the core during curing of the respective skin(s). In that case, the skins are coupled directly to the core without the use of a separate adhesive or binder apart from the concrete material itself. This construction technique eliminates the cost of separate adhesives and expensive lamination presses. In embodiments using CSA cement, the bond strength between the concrete material and the core may be sufficient without the addition of any bonding agents such as polymer. However, in some embodiments, one or more polymers (e.g., latex polymer, acrylic polymer, vinyl polymer, polyvinyl alcohol, or other polymers), may be added to further increase the bond strength between the concrete material and the core, to adjust the surface finish or texture of the surfaces of the skin(s), and/or to alter the workability of the concrete material. In some embodiments, such bonding agents may instead or in addition be coated directly onto the core prior to the application of the concrete material.

CSIPs made using CSA cement, or other FCLS cements, cure much more quickly and experience far less shrinkage than CSIPs made using traditional Portland cement mixtures. Accordingly, the CSIPs made according to the examples described herein are much more conducive to mass production. The shorter drying time means less manufacturing time, less time that the CSIPs occupy space in a factory, less or no need for additional curing equipment such as steam rooms or autoclaves, and consequently lower overhead than CSIPs made using Portland cement. Additionally, CSIPs made according to the examples described herein experience only minimal shrinkage during curing and, therefore, do not curl, warp, or crack during curing as would CSIPs made with concrete mixtures using Portland cement. Accordingly, it is possible to make much larger seamless CSIPs according to the examples described herein, than has ever been possible using existing CSIP construction techniques.

Depending on the desired fluidity of the concrete material during mixing and application, one or more plasticizers may be added to the concrete mixture to impart the desired characteristics to the mixture. Plasticizers that may be used include, by way of example and not limitation, polycarboxylate (PC) plasticizer, polycarboxylate ether superplasticizer (PCE), and/or lignosulfonate-based plasticizers.

The concrete materials used to make CSIPs according to this disclosure may include one or more aggregates, such as sand, gravel, calcium carbonate, perlite, pumice, previously cured particles of foamed or aerated cement, or other materials to impart the desired texture, performance, and characteristics of the concrete material. In one example, aggregate having a particles size of between about 10 mesh and about 100 mesh may be used. By way of example, and not limitation, sand having a desired coarseness may be employed to obtain a particular texture of the skins of the concrete material. Lighter weight aggregates such as calcium carbonate, perlite, pumice, or aerated or foamed concrete particles may be used to reduce a weight of the concrete material. Softer or more deformable aggregate materials (e.g., cellulose aggregate, plastic or polymeric aggregate, or the like) may be used to improve the concrete material's ability to be sawed or to receive and retain nails, screws or other fasteners.

In certain embodiments it may be desirable to speed up or retard the drying speed of the concrete material in order to allow sufficient time for mixing and application of the concrete material to the core. Depending on the cement(s) used, one or more accelerants (e.g., calcium chloride, calcium formate, Triethanolamine, calcium nitrite, hot water, etc.) or retarders (e.g., citric acid, ice, etc.) may be used to tailor the curing time of the concrete material to the manufacturing process.

The CSIPs are described in the context of making CSIPs for construction of walls, floors, ceilings, roofs and other portions of buildings. However, CSIPs may be used in other building and construction contexts as well, such as, for example, as sound barrier walls along freeways, enclosures of vehicles, fences, patios, retaining walls, marine applications (e.g., docks and piers), or the like.

Multiple and varied implementations and embodiments are described herein. The foregoing "Overview" and the following sections, including the section headings, are merely illustrative implementations and embodiments and should not be construed to limit the scope of the claims.

Example Concrete Structural Insulated Panels (CSIPs)

FIG. 1 is a schematic diagram of an example reinforced concrete structural insulated panel (CSIP) 100. The example CSIP 100 has a core 102 of insulating material sandwiched between two skins 104A and 104B of reinforced concrete material (collectively "skins 104"). The core 102 has a thickness $T_C$, and the first and second skins 104A and 104B have thicknesses $T_{S1}$ and $T_{S2}$, respectively. In some examples, the thickness $T_C$ may be between about 1 inch and about 12 inches, depending on the desired insulation value (e.g., thermal insulation or "R-value", acoustic insulation rating or decibel reduction, etc.). The thicknesses of the skins 104A and 104B may be the same or different, and each may be between about 0.125 inches and about 2 inches thick. However, in other examples, the core 102 and the skins 104 may have thicknesses greater or smaller than the ranges given. Furthermore, the thickness of either or both of the skins 104 may be variable (i.e., thicker in some places than others).

The thickness of the core 102 may be customized for a particular application or may be chosen to achieve a total CSIP thickness that matches an industry standard wall thickness. For instance, in one example, the core 102 may have a thickness $T_C$ of about 4 inches, so that when two 0.25 inch skins are applied the total thickness of the panel $T_{SIP}$ is 4.5 inches. As another example, the core 102 may have a thickness $T_C$ of about 5.5 inches, so that when two 0.5 inch skins are applied the total thickness of the panel $T_{SIP}$ is 6.5 inches. In still another example, the skins 104A and 104B may have different thicknesses. For instance, an exterior skin of a wall CSIP may be thicker (e.g., 0.5 inches) than an interior skin (e.g., 0.25 inches) to provide a more durable exterior surface. As another example, an interior skin of a ceiling or roof CSIP may be thicker (e.g., 0.375 inches) than an exterior skin (0.25 inches) to increase a load bearing weight of the ceiling or roof CSIP. In still other examples, one of the skins may be omitted entirely, such that the core has a reinforced concrete skin on only one side. These numerous other dimensional configurations are possible within the scope of this disclosure.

The CSIP 100 is also shown to have an overall length (L) and an overall height (H). The techniques described herein are usable to produce seamless CSIPs having substantially any height and/or length. In this way, CSIPs made by the techniques described herein may be built to order to any desired size (e.g., to the size of the entire wall of a building). However, in some examples, CSIPs may also be premade in certain stock sizes to match common industry standards (e.g., ceiling heights, wall lengths, truck beds or trailers, train cars, shipping containers, etc.). By way of example, stock CSIPs may be constructed to have heights H to accommodate common ceiling heights (e.g., 7.5 feet, 8 feet, 9 feet, 10 feet, 12 feet, etc.), and lengths L to accommodate common wall lengths (e.g., 8 feet, 10 feet, 12 feet, 16 feet, 24 feet, etc.) or truck, trailer, or shipping container lengths (36 feet, 40 feet, 50 feet, 60 feet, etc.).

Figure 2:
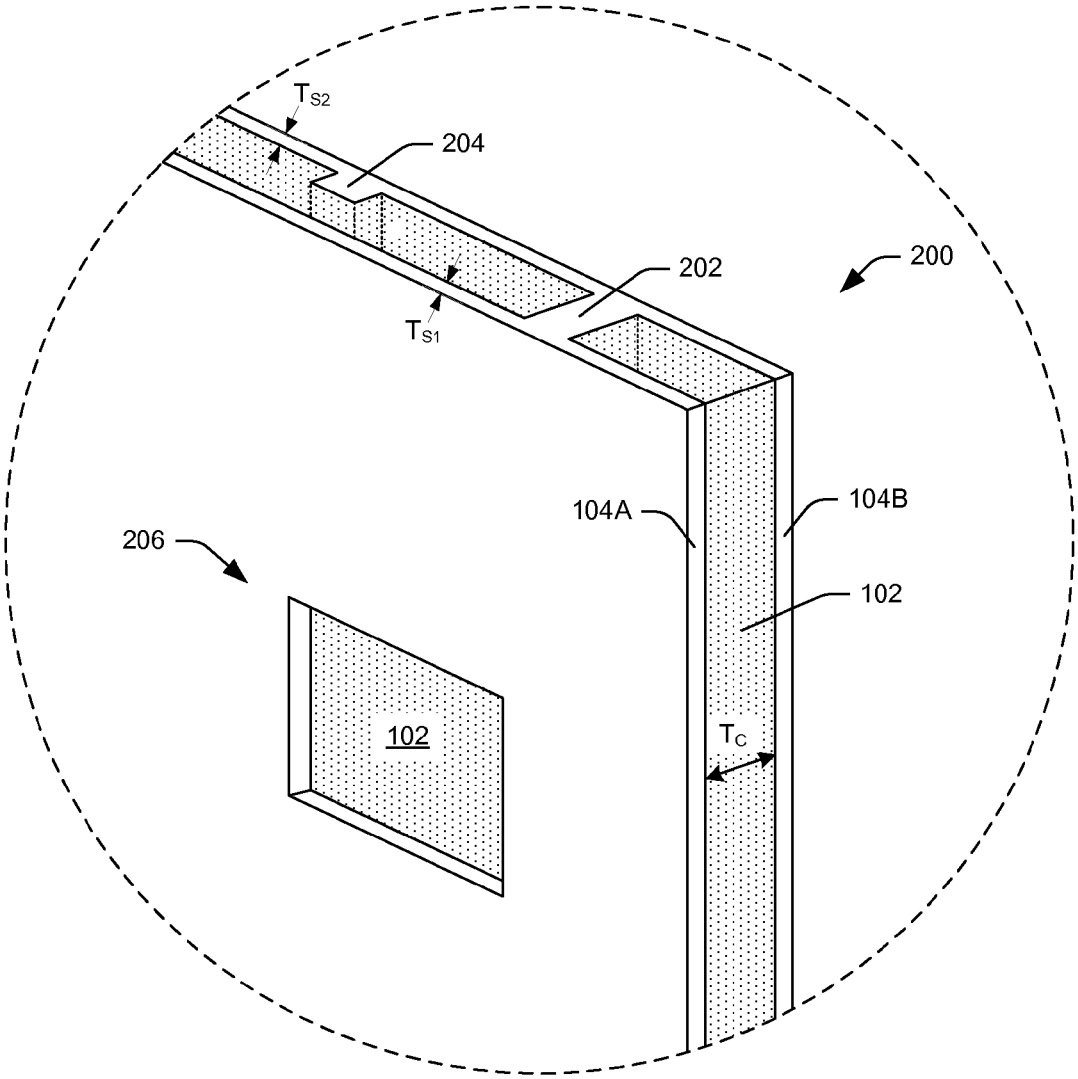
FIG. 2 is a detail view of a CSIP according to another embodiment, which illustrates features formed in the CSIP by varying a thickness of, and/or creating voids in, one or both skins of the CSIP.

FIG. 2 is a detail view of another CSIP 200 according to another embodiment, which illustrates several features that are made possible by the fact that the concrete material of the skins 104 is applied wet to the core 102. For example, the skins 104 can be made thinner and thicker in various sections (e.g., to form studs or stiffeners) and/or voids (e.g., for windows, receptacles, etc.) can be formed in the skins, as needed. As shown in FIG. 2, two cement studs 202 and 204 are formed integrally with the skins 104. Stud 202 is shown as a full stud spanning the distance between the first skin 104A and the second skin 104B. Stud 204 is shown as a partial stud formed as a thicker portion of the second skin 104B. FIG. 2 also illustrates a void 206 for a small window, allowing the core 102 to show through. Furthermore, different textures (e.g., smooth, popcorn, troweled, etc.) and surface finishes (e.g., gloss, matte, satin, etc.) can be imparted to the skins 104 at the time they are applied to the core 102. Such finishes can also be applied in secondary manufacturing processes made possible by applying the concrete materials of the skins 104 wet to the core 102, such as by sanding the skins smooth at an early stage of curing, wherein the faces are strong enough to withstand the pressure of sanding disks, but still soft enough to sand easily. These and numerous other advantages are made possible using the CSIP construction techniques described herein.

Figure 3:
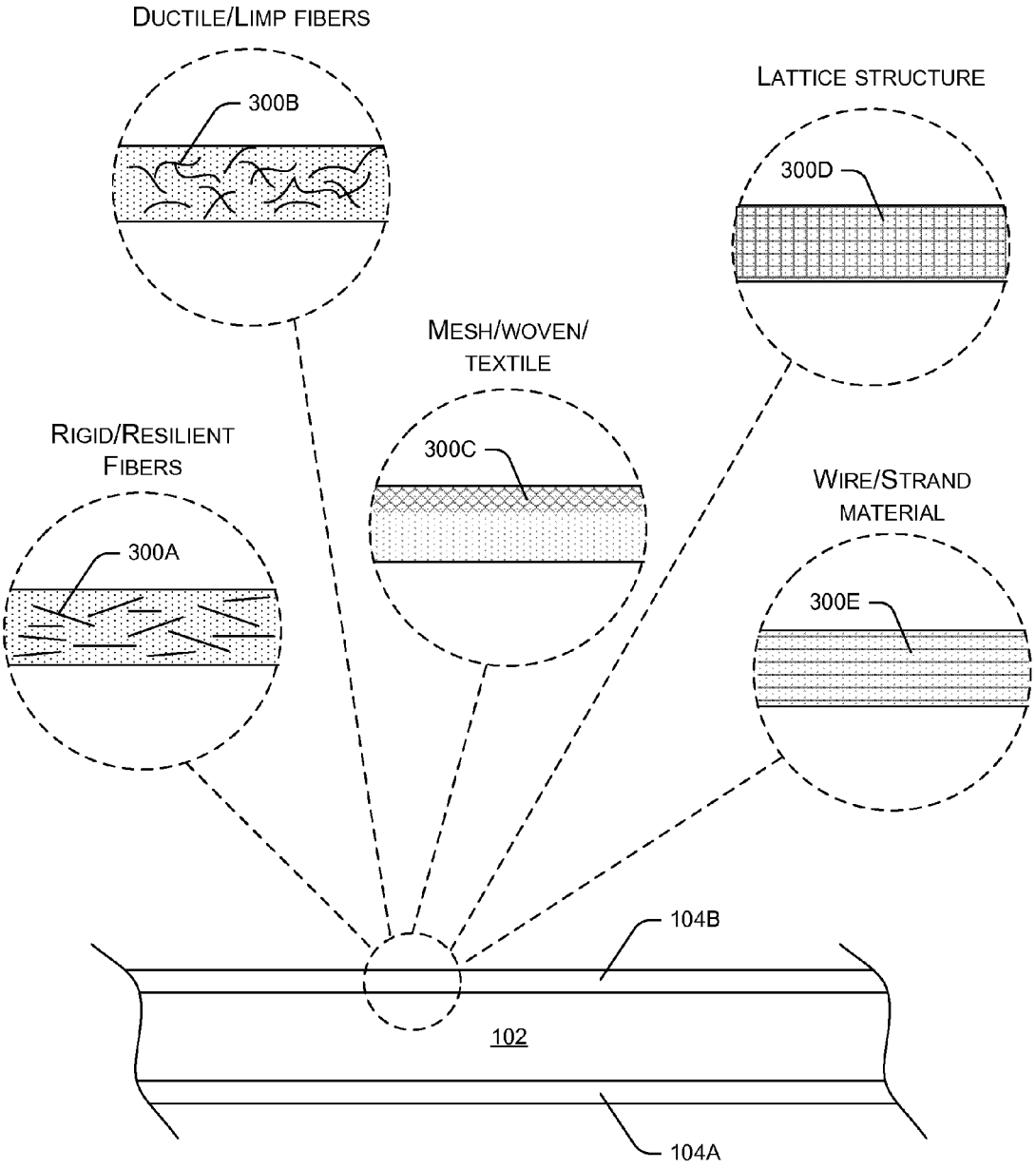
FIG. 3 is a schematic diagram showing a partial cross section of the reinforced CSIP of FIG. 1, along with multiple different reinforcing materials usable therewith.

FIG. 3 is a cross sectional view of the CSIP 100 of FIG. 1, with detail views showing several examples of reinforcing materials 300A-E (collectively "reinforcing materials 300") usable with the reinforced concrete material of the skins 104. Each of the example reinforcing materials 300A-E may be used separately or in combination with each other or other reinforcing materials.

Reinforcing material 300A is representative of rigid, semi-rigid, or resilient loose fibers, such as loose glass fibers (e.g., alkali resistant glass fibers), carbon fibers, or the like. Reinforcing material 300B is representative of flexible, ductile, or limp loose fibers, such as cellulose and other natural fibers, thin glass fibers, or the like. The shape and dimensions (e.g., diameter, length, width, thickness, etc.) of the loose fibers of reinforcing materials 300A and 300B may be uniform (i.e., the same dimensions throughout) or variable, and may be chosen based on the desired characteristics of the CSIPs (e.g., rigidity, resilience, strength, weight, etc.) and/or concrete material (e.g., workability, consistency, clumping, etc.) used to make the CSIPs. Moreover, while the reinforcing materials 300A and 300B are shown as being distributed evenly throughout the thickness of skin 104B, in other embodiments, the reinforcing materials may be arranged differently. In one example, the reinforcing materials may be distributed unevenly throughout one or both of the skins 104 (e.g., the reinforcing material may be disposed in or on one or both surfaces of the first skin 104A and/or the second skin 104B). In another example, different reinforcing material may be used in the first skin 104A than in the second skin 104B (e.g., glass fibers used in an exterior skin and cellulose fibers used in an interior skin).

The reinforcing material 300C is representative of a mesh, woven material, or textile. The mesh, woven material, or textile may be made of any material capable of being formed into a mesh, woven material, or textile such as, for example, glass, cellulose, metal, plastic, and/or ceramic. While the reinforcing material 300C is shown here on an exterior surface of the skin 104B, in other examples, the reinforcing material 300C may be disposed throughout a thickness of one or both of the skins 104, in a central portion of one or both of the skins 104, in isolated portions of one or both skins 104, or the like.

The reinforcing material 300D is representative of a lattice structure disposed in the skin 104B. The lattice structure may be disposed in, on, or throughout one or both of the skins, and may be made of any of the materials discussed with respect to the other reinforcing materials above. In one specific example of the reinforcing material 300D, the lattice structure may comprise a preformed ceramic or metal wire frame structure onto which the concrete material is applied. In that case, the concrete material permeates into the interstitial spaces of the lattice structure.

The reinforcing material 300E is representative of wires or strands of material (e.g., threads or fibers) disposed in the skin 104B. The wires or strands of material may be disposed in, on, or throughout one or both of the skins, and may be made of any of the materials discussed with respect to the other reinforcing materials above.

As mentioned above, in various embodiments, any or all of the reinforcing materials 300 described herein or other reinforcing materials may be used alone or in combination to construct CSIPs according to the techniques described herein.

Example Process of Making Concrete Structural Insulated Panels (CSIPs)

Figure 4:
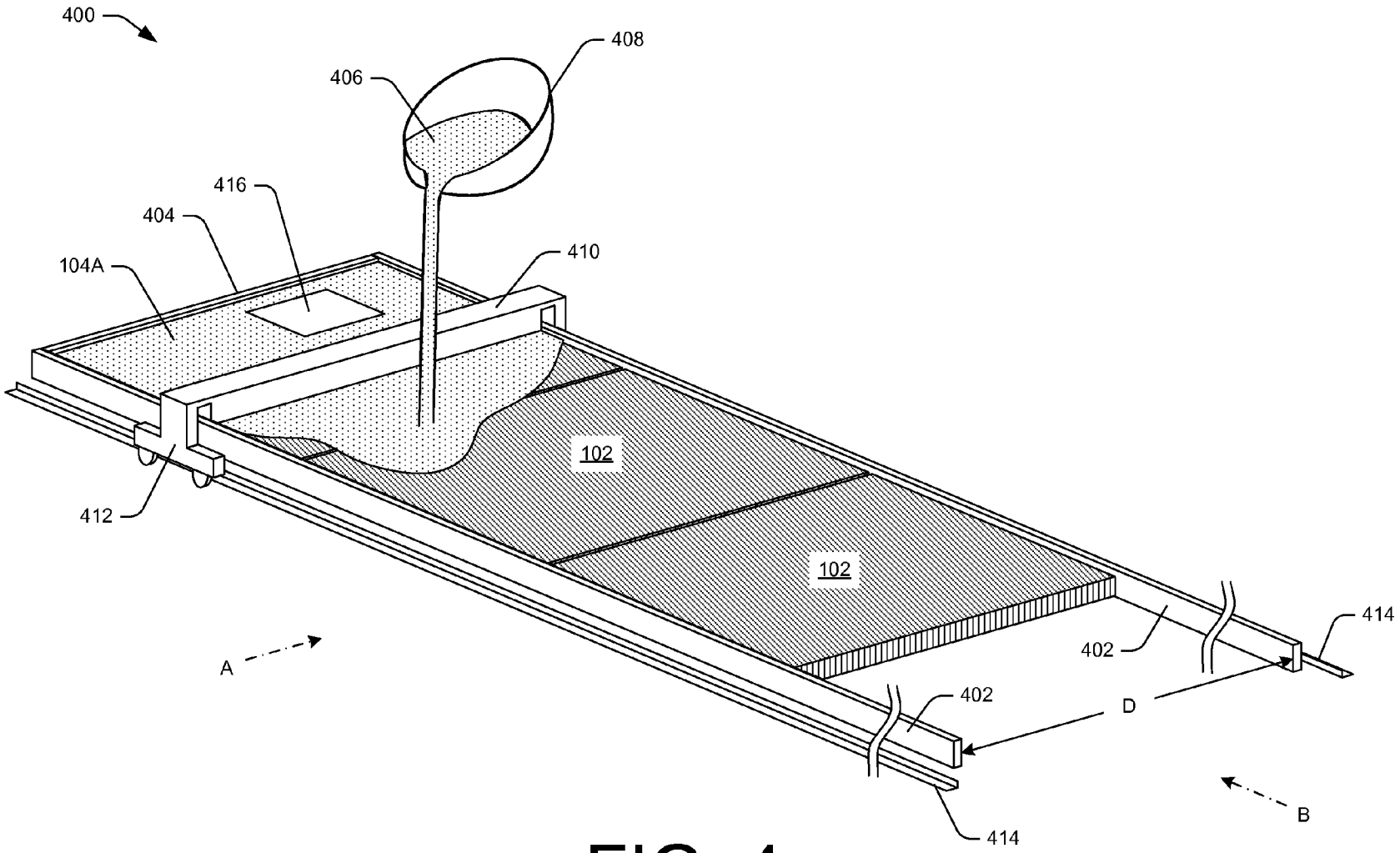
FIG. 4 is a schematic diagram showing an example system usable to manufacture a reinforced CSIP, such as the reinforced CSIP of FIG. 1 or 2.

FIGS. 4-7 illustrate an example process of making concrete structural insulated panels (CSIPs) such as, but not limited to, those described above with reference to FIGS. 1-3. FIG. 4 is a schematic diagram illustrating an example assembly line 400 usable to produce CSIPs. As shown in FIG. 4, the assembly line 400 includes a pair of side rails 402 disposed on a level surface. The side rails 402 bound the CSIPs on two sides, and define the top and bottom extents of the CSIPs. A distance D between the side rails 402 defines the height H of the CSIP. An end rail 404 bounds the CSIP at a first end thereof. An opposite end of the CSIP is open and unbounded by an end rail in FIG. 2.

The core 102 in this embodiment is illustrated as three foam blocks, which are placed flat on the level surface between the side rails 402. A first skin 104A is being applied to the CSIP by pouring a wet concrete material 406 from a bucket or other container 408 onto a first side of the core 102. In the illustrated embodiment, a concrete screed 410 is used to smooth and apply an even layer of the concrete material 406. The concrete screed 410 in this example is supported by a trolley 412, which rolls along a track 414. The track 414 is supported by the level surface and is aligned with the side rails 402. The side rails 402 are carefully leveled relative to the track 414 to ensure an even thickness of the concrete material over a length of the CSIP.

In some embodiments, the concrete screed 410 may be configured to vibrate and/or oscillate (side-to-side, front-to-back, and/or in a circular or orbital motion) under the power of a vibrator or electric motor, to achieve a smoother surface finish on the skin 104A and/or to avoid clumping of the reinforcing materials. For instance, certain of the concrete materials disclosed herein may be prone to clumping of the reinforcing materials and/or may result in a rough or uneven surface finish when applied using a traditional (non-vibrating and non-oscillating) screed. Vibrating the screed may improve the resulting surface finish for certain concrete materials, while oscillating the screed may minimize or prevent clumping of the reinforcing materials when used with certain concrete materials. In some embodiments, causing a screed to simultaneously vibrate and oscillate may result in a smooth surface finish while at the same time avoiding clumping of the reinforcing material during application to the core.

In the illustrated example, a form 416 is placed on the core 102 prior to applying the concrete material. The form 416 has a same thickness as the skin 104A that is being applied, and displaces concrete material from the space occupied by the form 416. Once the skin 104A has been applied and the concrete material has completely or partially cured, the form 416 may be removed to reveal a void. The foam core 102 may then be cut away within the void to receive a widow, receptacle, or other feature. Additionally, while not shown in this figure, one or more channels or indentions may be formed in the core 102 to create studs, supports, or other thicker regions of concrete material in the skin 104A, such as those shown in FIG. 2.

Figure 5:
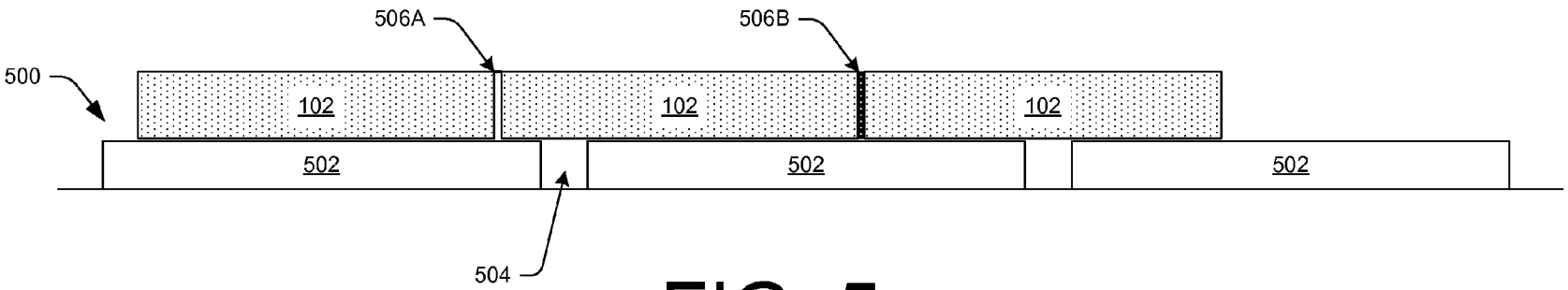
FIG. 5 is a simplified schematic view of the system of FIG. 4, viewed from the direction of arrow A in FIG. 4.

FIG. 5 is a schematic diagram showing a casting table 500 on which the system 400 of FIG. 4 rests. The view of FIG. 5 is taken from the transverse side indicated by arrow A in FIG. 4, with details of the side rails, trolley, and track omitted to provide a clear view of the casting table 500 and core 102. As shown in FIG. 5, the core 102 comprises multiple foam blocks placed substantially adjacent to one another along a length of the CSIP. The casting table 500 includes multiple raised plateaus 502 with slots 504 disposed between the plateaus at intervals spaced along the length of the casting table 500. The slots 504 accommodate straps to be placed under the CSIP to lift and move the CSIP after one or more concrete skins have been applied.

The raised plateaus 502 have a flat top surface on which the foam blocks of the core 102 are placed and held flat. The foam blocks and other insulating materials usable for the core tend to be bowed or otherwise not flat. Thus, a flat surface, such as the casting table 500, and some technique to hold the blocks flat against the flat surface are needed to maintain the foam blocks in a flat condition to apply the skins. Numerous techniques may be used to hold the foam blocks flat against the casting table 500, several examples of which are described below with reference to FIGS. 6A-6E.

Once the foam blocks are held flat on the casting table 500, the seams between adjacent foam blocks may be covered, filled, or sealed to prevent concrete material from filling the space between the foam blocks and/or displacing the foam blocks during the casting process. The seams may be covered, filled, or sealed by, for example, taping over the seam as shown at 506A, caulking the seam as shown at 506B, adhering the adjacent foam blocks together with an adhesive at the seam, and/or thermally or sonically welding the seam.

FIGS. 6A-6E are simplified schematic views of a portion of the system 400 of FIG. 4, as viewed from the longitudinal direction indicated by arrow B in FIG. 4. As noted above, foam blocks and other core materials tend to be bowed or uneven. FIGS. 6A-6E illustrate example techniques and equipment for holding the core 102 flat while casting the skins of concrete material. In all of the examples of FIGS. 6A-6B only one side of the system 400 is shown. However, it should be understood that the same or similar techniques and equipment may be used on the opposite side as well.

Figure 6C:
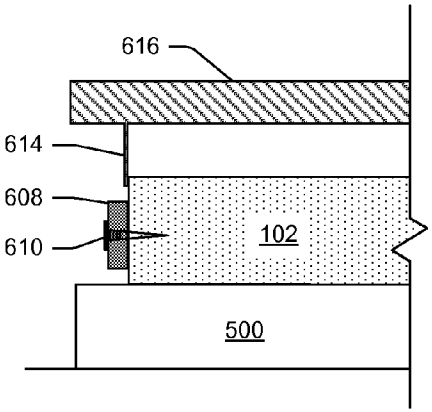
FIGS. 6A-6E are simplified schematic views of a portion of the system of FIG. 4, viewed from the direction of arrow B in FIG. 4.
Figure 6B:
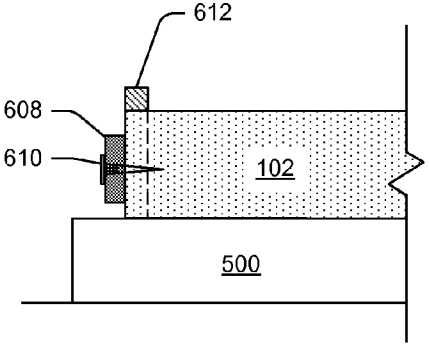
Figure 6A:
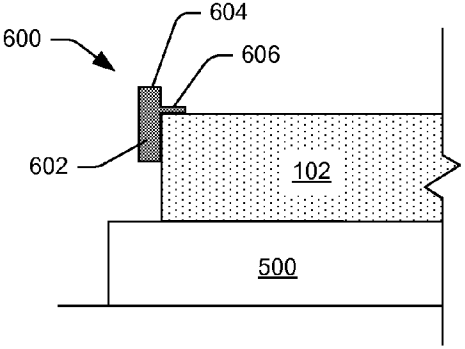

FIG. 6A illustrates an embodiment in which a weighted side rail 600 is used to hold the foam blocks of the core 102 flat against the casting table 500. The weighted side rail 600 includes a metal bar or other weighted portion 602 that extends along all or part of a length (into the page in this view) of the foam block(s). The weighted side rail 600 also includes a raised side rail portion 604 that serves as a guide to form an edge of the concrete skin and to define a thickness of the concrete skin. In this embodiment, a height of the raised side rail portion 604 defines the thickness of the concrete skin that is applied. A flange 606 of the weighted side rail 600 rests on an edge of the core 102 and the weight of the weighted side rail 600 presses the core 102 down flat against the casting table 500. After the skin has been cast and allowed to set, the weighted side rail 600 may be removed.

FIG. 6B illustrates an embodiment in which a metal bar or other weight 608 is fastened to an edge of the core 102 by a fastener 610. The weight 608 holds the foam block flat against the casting table 500. In this example, a separate side rail 612 is attached to a top of the core 102. The side rail 612 serves as a guide to form an edge of the concrete skin and to define a thickness of the concrete skin. A height of the separate side rail 612 defines the thickness of the concrete skin that is applied. In this example, after each skin has been cast, the side rail 612 may be removed prior to inverting the core 102. Once both skins have been cast, the weight 608 may be removed and an excess portion of the core 102 (e.g., the portion of the core on which the side rail 612 was disposed) may be trimmed from the CSIP.

FIG. 6C illustrates an embodiment in which, like the embodiment of FIG. 6B, a metal bar or other weight 608 is fastened to an edge of the core 102 by a fastener 610. The weight 608 holds the foam block flat against the casting table 500. In this example, however, a trailing side rail 614 is aligned with a transverse edge of the core 102 and is used to contain and define an edge of the concrete material that is applied as the skin until such a time as the concrete material is able to at least partially set. The trailing side rail 614 trails and moves along behind an application mechanism (e.g., extrusion nozzle or screed) used to apply the concrete material to the core 102. The trailing side rail 614 may be formed integrally with or otherwise coupled to the application mechanism, or may be separate from the application mechanism. Regardless of whether the trailing side rail 614 is coupled to or separate from the application mechanism, the trailing side rail 614 moves relative to the core to provide a boundary trailing the application mechanism to bound the concrete material until it can at least partially set. In this example, a thickness of the skin is defined by a spacing or setting of the application mechanism (e.g., a height of a screed above the surface of the core, a size and/or shape of an extrusion nozzle, etc.)

Figure 6D:
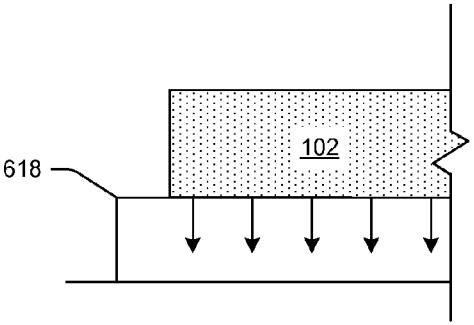

FIG. 6D illustrates an embodiment in which the casting table comprises a vacuum table 618 which is capable of pulling vacuum to hold the foam blocks or other core material flat against the table. In this embodiment, any of the side rail examples described above may be used to define an edge and/or thickness of the concrete skin(s) applied to the core 102.

Figure 6E:
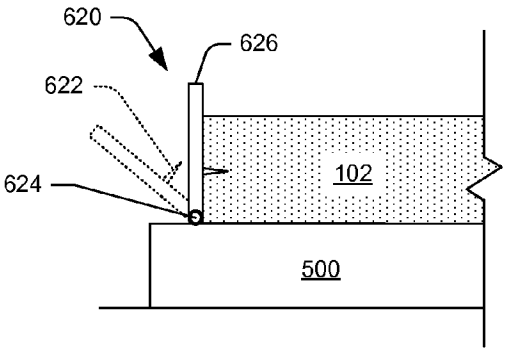

FIG. 6E illustrates an embodiment in which the core 102 is held flat against the casting table 500 by an anchor 620. The anchor 620 comprises a spike or other fastener 622 that can be driven into a transverse edge of the core 102 by pivoting the anchor 620 about a hinge pin 624 which secures the anchor 620 firmly to the casting table 500. When in the raised position, shown in solid lines in FIG. 6E, in which the fastener 622 engages the core 102, a vertically extending portion 626 of the anchor 620 may act as a side rail to define an edge and/or thickness of the concrete skin(s) applied to the core 102.

In each of the example embodiments of FIGS. 6A-6E, the concrete material may be applied to the core using any of the application techniques described herein, such as by pouring or pumping the concrete onto the core and leveling it with a screed, or by extruding the concrete material onto the core, for example. In the case of extrusion, the side rails may be omitted in some instances if the concrete material is extruded in a thick enough consistency and/or in a partially set condition.

Figure 7:
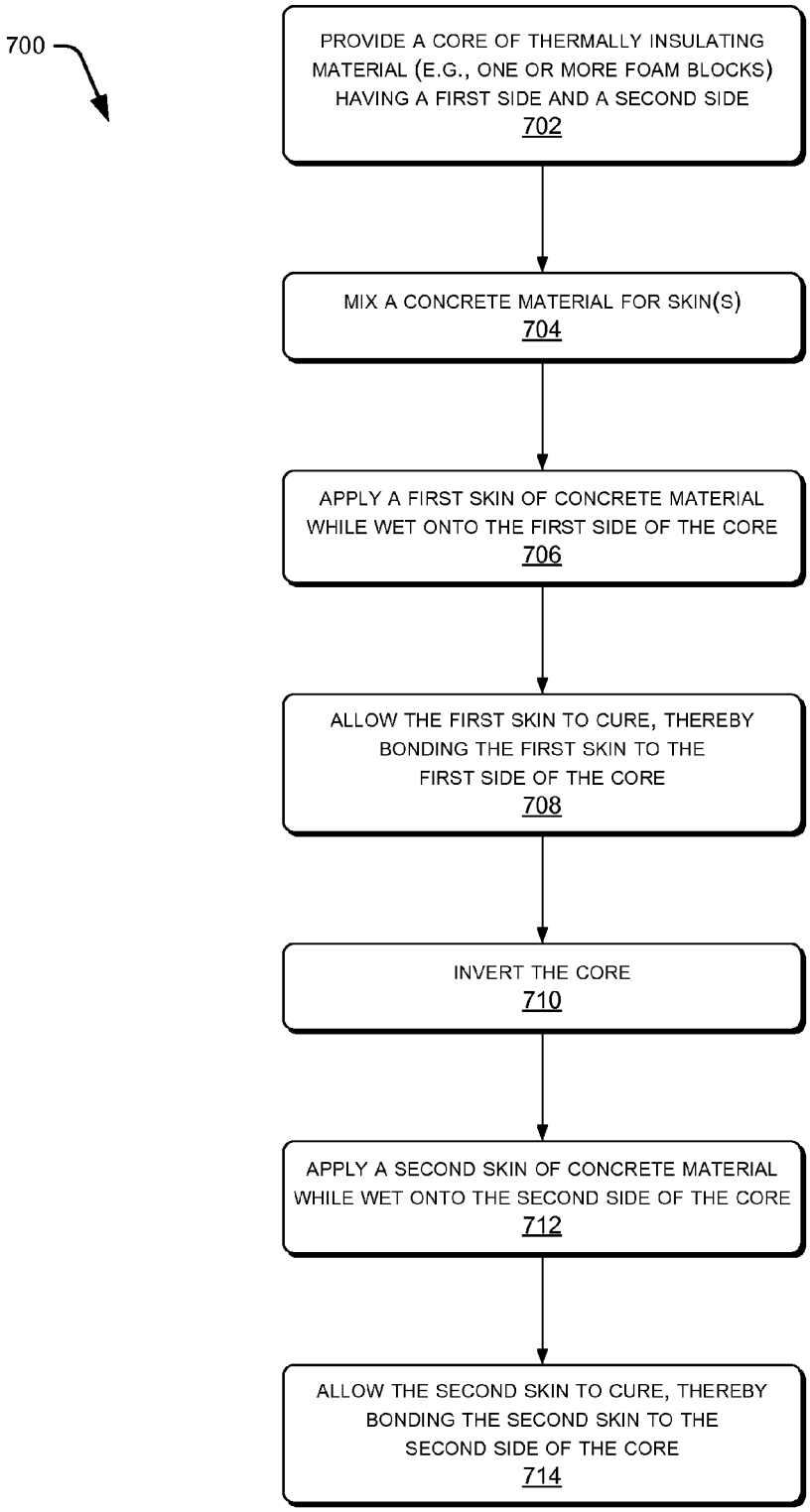
FIG. 7 is a flowchart illustrating an example method of making a reinforced CSIP, such as the reinforced CSIP of FIG. 1 or 2.

FIG. 7 is a flowchart illustrating an example method 700 of forming CSIPs such as those described with reference to FIGS. 1-3 and using an assembly line such as that shown in FIGS. 4, 5, and 6A-6E. However, the method 700 may be used to make CSIPs other than those described with reference to FIGS. 1-3, and may be performed using equipment other than the assembly line shown in FIG. 4. Moreover, other methods may be used to make the CSIPs described with reference to FIGS. 1-3 above.

Referring back to FIG. 7, the method 700 begins, at operation 702, with providing a core of thermally insulating material. The core may be made of any of the materials described above. In one example, however, the core comprises one or more foam blocks. In one example, "providing the core" may be accomplished by placing the one or more foam blocks on a casting table between two side rails of a CSIP assembly line. In other embodiments, other core materials may be used. Also in other embodiments, the core material may be provided in other ways, without being placed between side rails (e.g., as in several of the examples described above with reference to FIGS. 6B and 6C) and/or without being placed on a casting table (e.g., the core material could be supported in other ways such as by rollers, skids, conveyors, or the like).

At operation 704, a concrete material is mixed for one or both skins. In one example, concrete material is mixed for both skins at the same time. In another example, concrete material may be mixed for each skin just prior to applying the respective skin to the core. The mixture of the concrete material may vary, as discussed above, using any or all of the materials discussed above, depending on the desired characteristics of the CSIP and/or the concrete material. By way of example, the concrete material may comprise CSA cement in an amount between about 10% and about 80% by weight, one or more of the aggregates described herein in an amount between 0% and about 70% by weight, one or more of the reinforcing materials described herein in an amount between about 0.5% and about 10% by weight, one or more of the polymers described herein in an amount of between about 0.5% and about 5% by weight, and the balance water.

In one specific example, the concrete material comprises CSA cement in an amount between about 35% and about 45% by weight, one or more of the aggregates described herein in an amount between about 20% and about 60% by weight, one or more of the reinforcing materials described herein in an amount of about between 1% and about 5% by weight, one or more of the polymers described herein in an amount of between about 1% and about 3% by weight, and the balance water. However, in other embodiments, the concrete material may include more or less than the foregoing ranges of the listed components.

In some embodiments, the concrete mixture may consist of the components listed immediately above. In other embodiments, the concrete mixture may consist essentially of the components listed immediately above, but may also include an accelerator or retarder to adjust the curing time of the concrete material, a shrinkage reducing agent to manage an amount by which the concrete shrinks during curing, a hydration stabilizer, a plasticizer to adjust a consistency or workability of the concrete mixture, and/or a pigment or dye to adjust the color of the concrete mixture. In still other embodiments, the concrete material may comprise one or more other additives or components including but not limited to those described throughout this disclosure.

Referring back to FIG. 7, the method continues, at operation 706, with application of a first skin of the concrete material by, for example, pouring a continuous layer of concrete material while wet onto the first side of the core and using a concrete screed to level the first skin. In some embodiments the screed may impart a finished surface such that, once formed, the CSIPs may not need any trimming or finishing prior to use. However, in other embodiments various finishing operations may be applied to the CSIP skins after the casting. At operation 708, the first skin is allowed to cure, thereby bonding the first skin to the first side of the core without the need for a separate adhesive or binder other than the concrete mixture.

Once the first skin is completely or at least partially cured, if a second skin of concrete material is to be applied to the CSIP, at operation 710, the core is inverted and placed back down with the second side face up. At operation 712, a second skin of the same or different concrete material is applied to the second side of the core. At operation 714, the second skin is allowed to cure completely or at least partially, thereby bonding the second skin to the second side of the core without the need for a separate adhesive or binder other than the concrete mixture. In one specific example, the first skin is allowed to cure for about 2 to about 6 hours (until the skin is sufficiently cured to support its own weight and allow for handling) before the CSIP is inverted and the second skin is applied. In contrast, if made using traditional Portland cement, panels would require significantly longer (potentially multiple days) to cure sufficiently to withstand inverting and handling the CSIP.

In other embodiments, the first and/or second skins may be applied by other techniques, such as spraying, troweling, extruding, pultruding, casting, vibration casting, molding, or the like. Moreover, one or more other finishing or post processing operations may be performed as desired. For instance, the CSIPs may be sanded, sealed, textured, and or painted prior to or after being constructed into a building. In some instances, some of these operations (e.g., sanding) may be applied while the concrete material is only partially cured and is, therefore, softer.

The method 700 is illustrated as collections of blocks and/or arrows in a logical flowchart representing a sequence of operations that can be implemented to make a CSIP, such as those described with reference to FIGS. 1-3. The order in which the blocks are described is not intended to be construed as a limitation, and any number of the described operations can be combined in any order to implement the method, or alternate methods. For instance, in some examples, the concrete mixture may be mixed prior to providing the core, or the concrete material for each skin may be mixed separately just prior to applying the respective skin. As another example, while the first and second skins are described as being applied sequentially, in other embodiments, the first and second skins may be applied to the core simultaneously using any of the application techniques described herein. Additionally, individual operations may be omitted from the method without departing from the spirit and scope of the subject matter described herein. For instance, in some examples, a CSIP may be formed having only one reinforced concrete skin (the other skin being omitted entirely or being formed of a different material, for example). In that case, the second applying and curing operations may be omitted entirely.

Conclusion

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A structural insulated panel comprising:

a core of thermally insulating material having a first side and a second side opposite the first side;

a first skin coupled to the first side of the core;

a second skin coupled to the second side of the core; and a stud extending at least partly across a distance between the first skin and the second skin, the stud being an integral part of the first skin, wherein the first skin, the second skin, or both the first and second skins include a sheet of reinforced concrete material, the sheet of reinforced concrete material including:

a cement including calcium sulfoaluminate (CSA) cement in an amount greater than 10% by weight and bonding polymers in an amount less than 5% by weight, and a reinforcing material disposed in at least a portion of the CSA cement.

2. The structural insulated panel of claim 1, wherein the cement consists essentially of CSA cement.

3. The structural insulated panel of claim 1, wherein the cement further includes Portland cement.

4. The structural insulated panel of claim 3, wherein the reinforced concrete material further includes at least one of a pozzolan, an accelerator, a shrinkage reducing agent, or a hydration stabilizing agent.

5. The structural insulated panel of claim 1, wherein the core of thermally insulating materials comprises at least one of polystyrene foam, polyurethane foam, polyisocyanurate foam, foamed or aerated concrete, or concrete mixed with one of more materials having a density less than concrete.

6. The structural insulated panel of claim 1, wherein both the first and second skins are coupled directly to the core without a separate adhesive or binder.

7. The structural insulated panel of claim 1, wherein the reinforced concrete material further comprises a pozzolan.

8. The structural insulated panel of claim 1, wherein the reinforcing material comprises at least one of loose fibers, mesh material, woven or textile material, a lattice structure, or wire material.

9. The structural insulated panel of claim 1, wherein the reinforcing material comprises at least one of glass, cellulose, metal, plastic, or ceramic.

10. The structural insulated panel of claim 1, further comprising a plasticizer and an aggregate.

11. The structural insulated panel of claim 1, wherein the first skin, the second skin, or both the first and second skins have a thickness of at least about 0.125 inch and at most about 1 inch.

12. The structural insulated panel of claim 1, wherein the first skin, the second skin, or both the first and second skins have a first region having a thickness of at least about 0.125 inch and at most about 0.5 inch, and wherein the first skin, the second skin, or both the first and second skins have a second region having a thickness greater than the thickness of the first region.

13. The structural insulated panel of claim 1, wherein the first skin, the second skin, or both the first and second skins include an area within a perimeter of the respective skin(s) that is void of concrete material.

14. The structural insulated panel of claim 1, wherein the first skin, the second skin, or both the first and second skins have a continuous seamless length greater than about 8 feet.

15. The structural insulated panel of claim 1, wherein the first skin, the second skin, or both the first and second skins have a continuous seamless length of at least about 40 feet.

16. The structural insulated panel of claim 1, wherein the reinforced concrete material consists essentially of:

the CSA cement;

reinforcing material;

pozzolan;

the bonding polymers;

aggregate; and water.

17. The structural insulated panel of claim 1, wherein the reinforced concrete material consists essentially of:

the CSA cement;

Portland cement;

reinforcing material;

pozzolan;

the bonding polymers;

aggregate; and water.

18. The structural insulated panel of claim 1, wherein the stud extends completely across a distance between the first skin and the second skin.

19. The structural insulated panel of claim 1, wherein the stud extends only partially across a distance between the first skin and the second skin.

20. The structural insulated panel of claim 1, wherein the sheet of reinforced concrete material comprises a cement including CSA cement in an amount greater than 10% and up to about 80% by weight, polymers in an amount of about 0.5% up to less than 5% by weight, one or more aggregates in an amount between 0% and about 70% by weight, and one or more reinforcing materials in an amount between about 0.5% and about 10% by weight, and water.

21. The structural insulated panel of claim 1, wherein the sheet of reinforced concrete material comprises a cement including CSA cement in an amount between about 35% and about 45% by weight, polymers in an amount between about 1% and about 3% by weight, one or more aggregates in an amount between about 20% and about 60% by weight, and one or more reinforcing materials in an amount between about 1% and about 5% by weight, and water.

22. The structural insulated panel of claim 1, wherein the reinforcing material is distributed unevenly throughout one or both of the skins.

23. A structural insulated panel comprising:

a core of thermally insulating material having a first side and a second side opposite the first side;

a first skin coupled directly to the first side of the core;

a second skin coupled directly to the second side of the core; and a stud extending at least partly across a distance between the first skin and the second skin, the stud being an integral part of the first skin, wherein the first skin, the second skin, or both the first and second skins include a sheet of reinforced concrete material, the sheet of reinforced concrete material including:

a cement including calcium sulfoaluminate (CSA) cement in an amount greater than 10% by weight and bonding polymers in an amount less than 5% by weight, a plasticizer, an aggregate and a reinforcing material disposed in at least a portion of the CSA cement, the reinforcing material including at least one of glass, cellulose, metal, plastic, or ceramic, and the reinforcing material being in the form of at least one of loose fibers, mesh material, woven or textile material, a lattice structure, or wire material.

24. The structural insulated panel of claim 23, wherein the stud extends completely across a distance between the first skin and the second skin.

25. The structural insulated panel of claim 23, wherein the stud extends only partially across a distance between the first skin and the second skin.

26. A structural insulated panel comprising:

a core of thermally insulating material having a first side and a second side opposite the first side;

a first skin coupled to the first side of the core;

a second skin coupled to the second side of the core; and wherein the first skin, the second skin, or both the first and second skins include a sheet of reinforced concrete material, the sheet of reinforced concrete material including:

a cement including calcium sulfoaluminate (CSA) cement in an amount greater than 10% by weight and bonding polymers in an amount less than 5% by weight, and a reinforcing material disposed in at least a portion of the CSA cement.

27. The structural insulated panel of claim 26, wherein at least one of the first skin and the second skin is directly coupled to one of the first and second sides of the core without a separate adhesive or binder.

28. The structural insulated panel of claim 26, wherein at least one of the first skin and the second skin comprises a cement including CSA cement in an amount greater than 10% and up to about 80% by weight, polymers in an amount of about 0.5% up to less than 5% by weight, one or more aggregates in an amount between 0% and about 70% by weight, and one or more reinforcing materials in an amount between about 0.5% and about 10% by weight, and water.

29. The structural insulated panel of claim 26, wherein at least one of the first skin and the second skin comprises a cement including CSA cement in an amount between about 35% and about 45% by weight, polymers in an amount between about 1% and about 3% by weight, one or more aggregates in an amount between about 20% and about 60% by weight, and one or more reinforcing materials in an amount between about 1% and about 5% by weight, and water.

30. The structural insulated panel of claim 26, further comprising a reinforcing material distributed unevenly throughout at least one of the first skin and the second skin.

* * * * *